US012546184B2

(12) United States Patent
Couturier et al.

(10) Patent No.: US 12,546,184 B2
(45) Date of Patent: Feb. 10, 2026

(54) CHOKE SYSTEM TO CONTROL FLUID PRESSURE

(71) Applicant: Schlumberger Technology Corporation, Sugar Land, TX (US)

(72) Inventors: Yawan Couturier, Katy, TX (US); Steven Dornak, Damon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/678,294

(22) Filed: May 30, 2024

(65) Prior Publication Data

US 2025/0369307 A1 Dec. 4, 2025

(51) Int. Cl.
*E21B 34/02* (2006.01)
*E21B 21/10* (2006.01)

(52) U.S. Cl.
CPC ..... *E21B 34/025* (2020.05); *E21B 21/106* (2013.01)

(58) Field of Classification Search
CPC ..... E21B 34/025; E21B 21/106
See application file for complete search history.

(56) References Cited

U.S. PATENT DOCUMENTS 5,279,363 A 1/1994 Schultz
5,332,035 A 7/1994 Schultz
5,375,658 A 12/1994 Schultz
5,396,167 A * 3/1995 Leon ..... F16K 37/0083 324/73.1
5,916,325 A 6/1999 Madrid
6,691,587 B1 2/2004 King
8,464,799 B2 6/2013 Scott
8,596,608 B2 12/2013 Grimseth
8,680,704 B1 * 3/2014 Rooney ..... E21B 41/0085 290/54

(Continued)

FOREIGN PATENT DOCUMENTS

CA 3058452 A1 10/2018
EP 2556281 A1 2/2013
WO 2023027944 A1 3/2023

OTHER PUBLICATIONS

"3 Servo Motor Control Modes Explained", downloaded from the internet on Mar. 31, 2025 from [https://web.archive.org/web/20240528075005/https:/www.machinemfg.com/control-modes-of-servo-motor/}, MachineMFG, 2023, 10 pages.

(Continued)

*Primary Examiner* — Patrick C Williams
(74) *Attorney, Agent, or Firm* — Jeffrey D. Frantz

(57) ABSTRACT

A choke system for oilfield operations including an actuator; a choke including: a housing defining an interior flow path; a choke plunger coupled to and movable by the actuator; and a choking member coupled to and movable by the choke plunger within the interior flow path to adjust a pressure of a fluid in the interior flow path; a sensor external to the choke, the sensor configured to measure an actuator parameter; and a control system configured to control the pressure of the fluid by: determining the pressure of the fluid based on the actuator parameter measured by the sensor, and wherein the actuator parameter is proportional to the pressure of the fluid; and actuating the actuator to cause the choking member to move within the interior flow path until the pressure of the fluid reaches a desired pressure.

13 Claims, 5 Drawing Sheets

(56) References Cited

U.S. PATENT DOCUMENTS

| | | | | |
|---|---|---|---|---|
| 9,145,979 | B2 | 9/2015 | Hoang | |
| 9,291,033 | B2 | 3/2016 | Scott | |
| 9,627,940 | B2 | 4/2017 | Eriksen | |
| 9,816,592 | B1 | 11/2017 | Glikin | |
| 10,006,475 | B2 | 6/2018 | Jurczyk | |
| 10,007,273 | B2 | 6/2018 | Martino | |
| 10,190,682 | B2 | 1/2019 | Paisley | |
| 10,329,860 | B2 | 6/2019 | Boutalbi | |
| 10,352,468 | B2 | 7/2019 | Easter | |
| 10,536,052 | B2 | 1/2020 | Bourgoine | |
| 10,648,315 | B2 | 5/2020 | Couturier | |
| 10,738,552 | B1 | 8/2020 | Parker | |
| 10,801,303 | B2 | 10/2020 | Gray | |
| 10,968,710 | B1 | 4/2021 | Parker | |
| 11,021,918 | B2 | 6/2021 | Parthasarathy | |
| 11,131,156 | B2 | 9/2021 | Dillard | |
| 11,339,620 | B2 | 5/2022 | Johnson | |
| 11,428,069 | B2 | 8/2022 | Affleck | |
| 11,466,524 | B2 | 10/2022 | Johnson | |
| 11,486,211 | B2 | 11/2022 | Parthasarathy | |
| 11,585,169 | B2 | 2/2023 | Liezenberg | |
| 11,608,710 | B2 | 3/2023 | Gray | |
| 11,643,891 | B2 | 5/2023 | Brana | |
| 11,649,837 | B2 | 5/2023 | Khorshidian | |
| 11,719,059 | B1 | 8/2023 | Parker | |
| 11,952,861 | B2 | 4/2024 | Hofacker | |
| 2005/0000580 | A1* | 1/2005 | Tranovich | F16K 37/0041 137/625.65 |
| 2005/0092523 | A1 | 5/2005 | McCaskill | |
| 2006/0192160 | A1* | 8/2006 | Cove | E21B 34/025 251/62 |
| 2011/0083746 | A1 | 4/2011 | Hoang | |
| 2022/0112788 | A1* | 4/2022 | Richard | H02K 5/136 |
| 2022/0349275 | A1 | 11/2022 | Shpak | |
| 2023/0228320 | A1 | 7/2023 | Kalvatn | |
| 2023/0279878 | A1 | 9/2023 | Khorshidian | |
| 2023/0313639 | A1 | 10/2023 | Urdaneta | |

OTHER PUBLICATIONS

"What are PCB Mount Servo Drives Top 6 Benefits", downloaded on Mar. 14, 2025 from the internet at [https://www.a-m-c.com/pcb-mount-servo-drives-top-6-benefits/], Advanced Motor Controls, 2024, 7 pages.

"Clear Path Integrated Servo Motors", downloaded on Mar. 14, 2025 from the internet at[https://teknic.com/products/clearpath-brushless-dc-servo-motors/], Teknic, Undated, 6 pages.

"Servo Motor Torque Control", downloaded on Mar. 14, 2025 from the internet at [https://www.futek.com/applications/Servo-Motor-Torque-Control], Futek, undated, 5 pages.

"Torque meter in variable speed drive systems", downloaded on Mar. 14, 2025 from the internet at [https://mb-drive-services.com/torque-meter-in-variable-speed-drive-systems/], MB Drive Systems, 2021, 13 pages.

"Application Note AN-SERV-002", downloaded on Mar. 14, 2025 from the internet at [https://support.automationdirect.com/docs/an-serv-002.pdf#page39], Automation Direct, 2006, 20 pages.

"Wiring a Pressure Transducer to a VFD", downloaded on Mar. 14, 2025 from the internet at [https://www.emotorsdirect.ca/knowledge-center/article/wiring-a-pressure-transducer-to-a-vfd], eMotors Direct, 2023, 8 pages.

"What is regenerative braking in variable frequency drives", downloaded on Mar. 14, 2025 from the internet at[http://www.gohz.com/what-is-regenerative-braking-in-vfd], GoHz, 2015, 3 pages.

"Drive-Integrated Servo Motor (DI020)", downloaded on Mar. 17, 2025 from the Internet at [https://www.moog.com/products/drives-servodrives/Decentralized-Solutions/DI2020-Drive-Integrated-Servo-Motor.html], MOOG, 2025, 5 pages.

* cited by examiner

CHOKE SYSTEM TO CONTROL FLUID PRESSURE

BACKGROUND

Field

The present disclosure generally relates to choke systems to control one or more fluid properties, such as pressure.

Description of the Related Art

Managed pressure drilling systems include a choke to adjust the pressure of the fluid in an annulus. Conventional managed pressure drilling systems include a pressure sensor in line with the choke to measure the pressure of the fluid. However, the fluid may be compressible due to gases and have cuttings suspended therein that impact the ability of the pressure sensor to determine the actual pressure of the fluid flowing into the choke in real time, thereby causing the resulting data to be noisy. Conventional managed pressure drilling systems close the choke slowly to compensate for the inability to accurately measure the pressure of the fluid. There is a need in the art for improved choke control to allow for a faster movement of the choke to improve the controllability of the choke.

SUMMARY

Aspects of the present disclosure provide systems, apparatus, and methods for a choking system for oilfield operations.

In one aspect a choke system for oilfield operations, comprising: an actuator; a choke including: a housing defining an interior flow path; a choke plunger coupled to and movable by the actuator; and a choking member coupled to and movable by the choke plunger within the interior flow path to adjust a pressure of a fluid in the interior flow path; a force sensor disposed between the actuator and the choking member, the force sensor configured to measure a force exerted on the choking member by the fluid; and a control system configured to control the pressure of the fluid by: determining the pressure of the fluid based on the force measured by the force sensor, and wherein the force is proportional to the pressure of the fluid; and actuating the actuator to cause the choking member to move within the interior flow path until the pressure of the fluid reaches a desired pressure.

In one aspect, a choke system for oilfield operations, comprising: an actuator; a choke including: a housing defining an interior flow path; a choke plunger coupled to and movable by the actuator; and a choking member coupled to and movable by the choke plunger within the interior flow path to adjust a pressure of a fluid in the interior flow path; a sensor external to the choke, the sensor configured to measure an actuator parameter; and a control system configured to control the pressure of the fluid by: determining the pressure of the fluid based on the actuator parameter measured by the sensor, and wherein the actuator parameter is proportional to the pressure of the fluid; and actuating the actuator to cause the choking member to move within the interior flow path until the pressure of the fluid reaches a desired pressure.

In one aspect, a method for managing a choked fluid pressure, comprising: measuring a parameter of an actuator coupled to a choke with a sensor while a fluid is flowing through an interior flow path of the choke; and applying a force with the actuator to a choking member of the choke disposed within an interior flow path to change a pressure of the fluid based on the measured parameter.

The following description and the appended figures set forth certain features for purposes of illustration.

BRIEF DESCRIPTION OF DRAWINGS

The appended figures illustrate only exemplary embodiments and are therefore not to be considered limiting of the scope of the disclosure, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Aspects of the present disclosure provide systems, apparatus, and methods to a control valve with improved reaction time to increase the ability of the control valve to control one or more parameters of fluid flow. The control valve disclosed herein includes a sensor that is not in direct fluid communication with the fluid flowing through the control valve to determine one or more parameters of the fluid flow which may be used by the control valve to control the fluid flow. The description of an example implementation of the disclosure that follows is explained in terms of a control valve (controllable orifice choke, or similarly designated device) that provides a controllable restriction of flow of fluid out of a wellbore. The controlled restriction may be used for, among other purposes, maintaining a selected fluid pressure within the wellbore. It should be understood that the present invention has application beyond control of fluid discharge from a wellbore, as will be apparent from the following description and claims.

Figure 1:
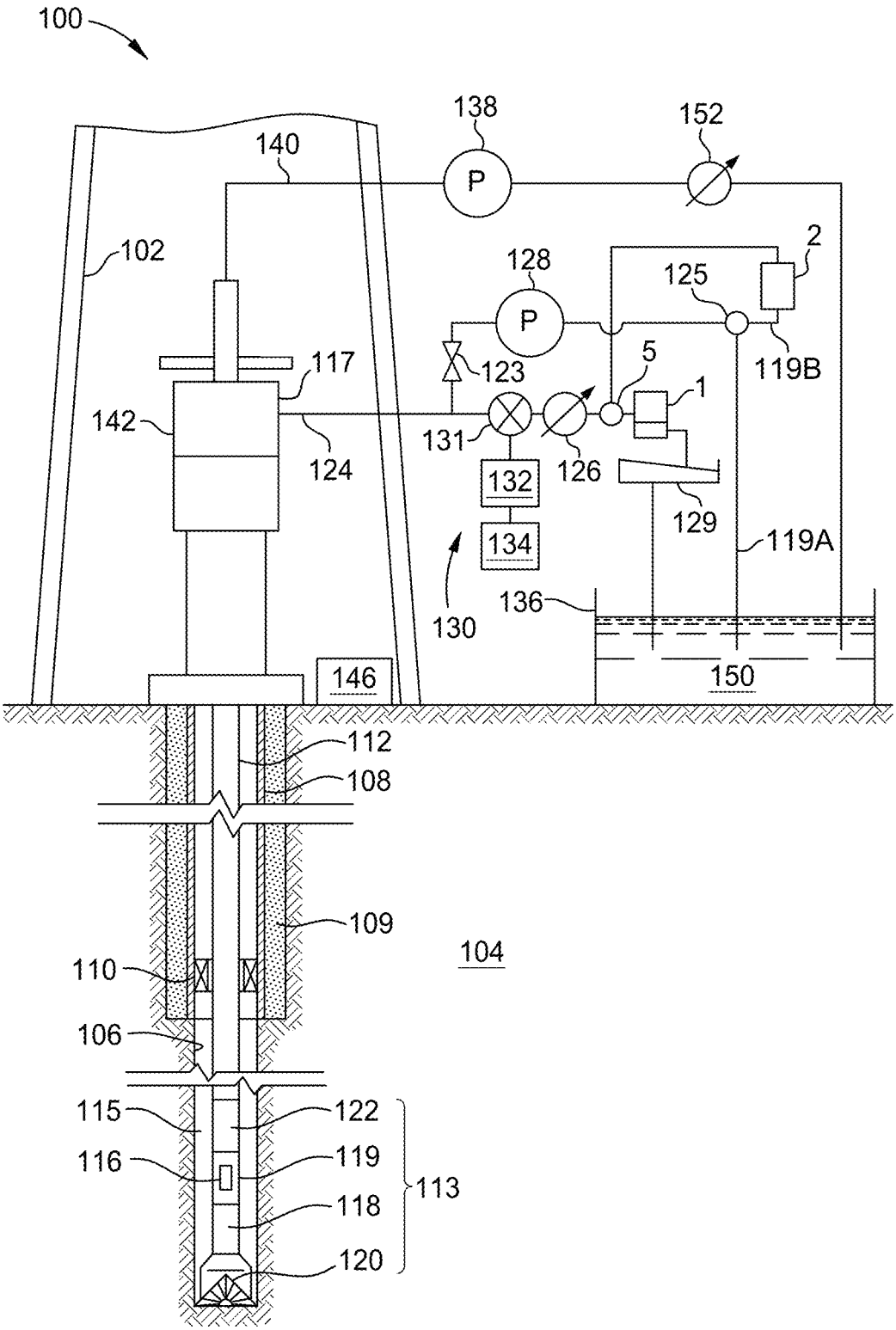
FIG. 1 is an exemplary drilling system using dynamic annular pressure control, according to one or more embodiments of the disclosure.

FIG. 1 is a plan view of an exemplary drilling system having a managed pressure drilling system. It will be appreciated that either a land based or an offshore drilling system may have a managed pressure drilling system as shown in FIG. 1. The drilling system 100 is shown including a drilling rig 102 that is used to support drilling operations. Certain components used on the drilling rig 102, such as the kelly, power tongs, slips, draw works and other equipment are not shown separately in the Figures for clarity of the illustration. The rig 102 is used to support a drill string 112 used for drilling a wellbore through Earth formations such as shown as formation 104. FIG. 1 shows that wellbore 106 has already been partially drilled and a protective pipe or casing 108 is set and cemented 109 into place in the previously drilled portion of the wellbore 106. In the present example, a casing shutoff mechanism, or downhole deployment valve, 110 may be installed in the casing 108 to shut off the annulus 115 and effectively act as a valve to shut off the open hole section of the wellbore 106 (the portion of the wellbore 106 below the bottom of the casing 108) when a drill bit 120 is located above the valve 110.

The drill string 112 supports a bottom hole assembly (BHA) 113 that may include the drill bit 120, an optional hydraulically powered ("mud") motor 118, an optional measurement and logging-while-drilling (MWD/LWD) sensor system 119 that preferably includes a pressure transducer 116 to determine the annular pressure in the wellbore 106. The drill string 112 may include a check valve (not shown) to prevent backflow of fluid from the annulus 115 into the interior of the drill string 112 should there be pressure at the surface of the wellbore. The MWD/LWD suite 119 may include a telemetry system 122 that is used to transmit pressure data, MWD/LWD sensor data, as well as drilling information to the Earth's surface. While FIG. 1 illustrates a BHA using a mud pressure modulation telemetry system, it will be appreciated that other telemetry systems, such as radio frequency (RF), electromagnetic (EM) or drill string transmission systems may be used with the present invention.

The drilling process requires the use of drilling fluid 150, which is typically stored in a tank, pit or other type of reservoir 136. The reservoir 136 is in fluid communication with one or more rig mud pumps 138 which pump the drilling fluid 150 through a conduit 140. The conduit 140 is hydraulically connected to the uppermost segment or "joint" of the drill string 112 (using a swivel in a kelly or top drive). The drill string 112 passes through a rotating control head or "rotating BOP" 142. When activated, the rotating BOP 142 closes around the drill string 112 and isolates the fluid pressure in the wellbore annulus 115 while still enabling drill string rotation and longitudinal movement. The fluid 150 is pumped down through an interior passage in the drill string 112 and the BHA 113 and exits through nozzles or jets (not shown separately) in the drill bit 120, whereupon the fluid 150 circulates drill cuttings away from the bit 120 and returns the cuttings upwardly through the annulus 115 between the drill string 112 and the wellbore 106 and through the annular space formed between the casing 108 and the drill string 112. The fluid 150 ultimately returns to the Earth's surface and is diverted by the rotating BOP 142 through a diverter 117, through a conduit 124 and various surge tanks and telemetry receiver systems (not shown separately).

Thereafter the fluid 150 proceeds to what is generally referred to herein as a backpressure system which may consist of a choke system 130, valve 123 and pump pipes and optional pump as shown at 128. The fluid 150 enters the backpressure system and may flow through an optional flow meter 126.

Figure 3:
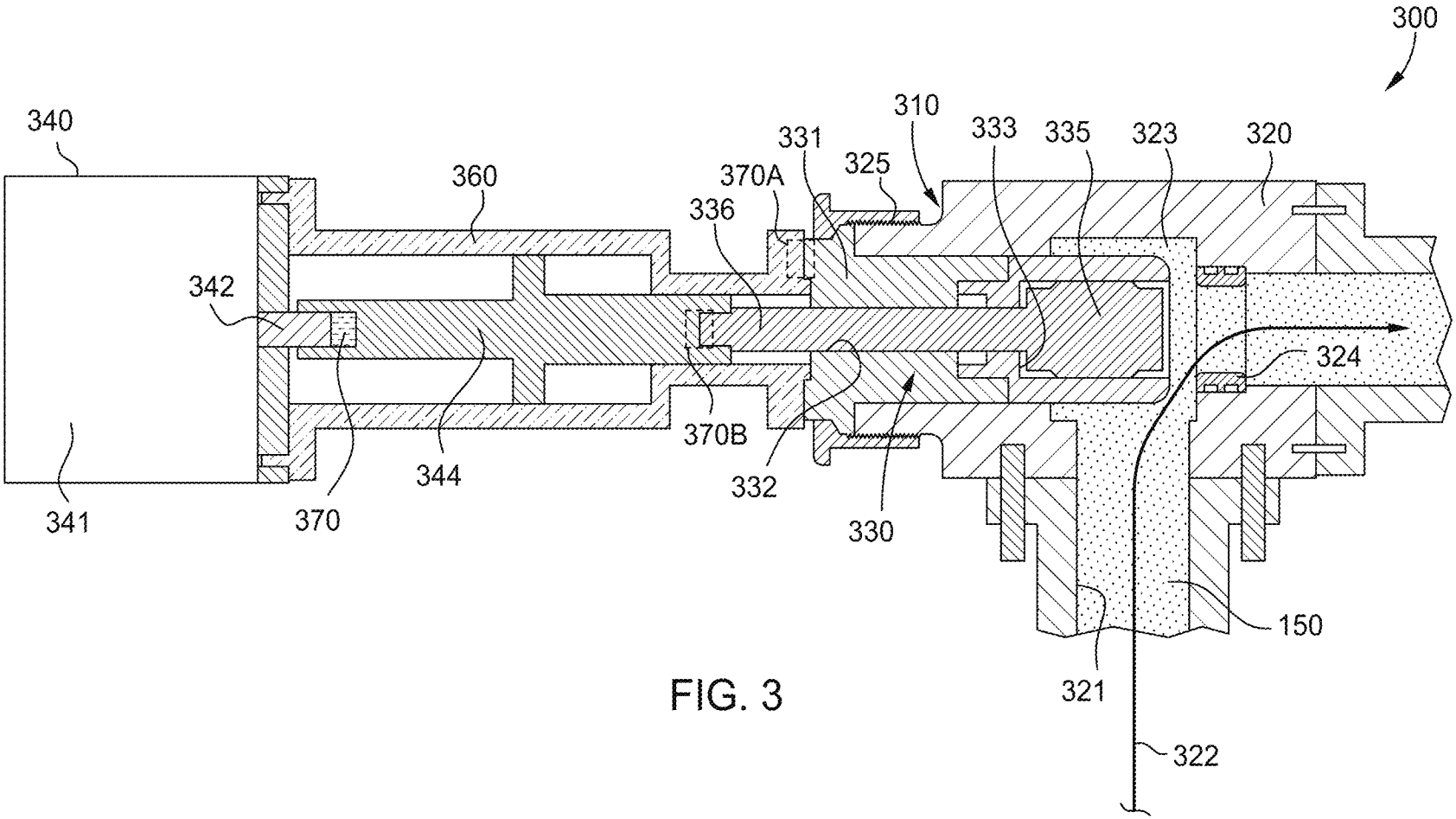
FIG. 3 is an exemplary choke system with a force sensor, according to one or more embodiments of the disclosure.
Figure 4:
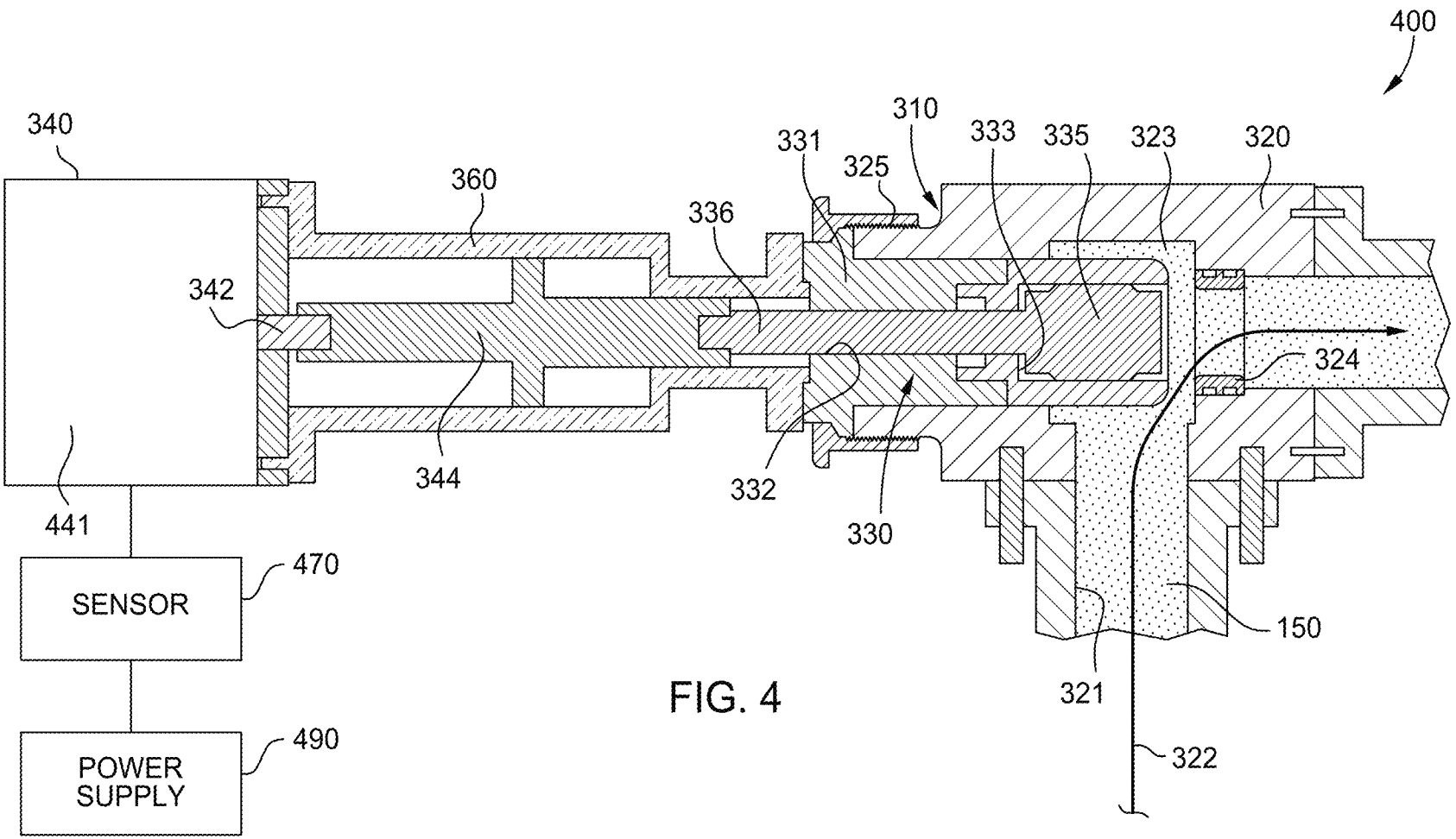
FIG. 4 is an exemplary choke system with a current sensor, according to one or more embodiments of the disclosure.
Figure 5:
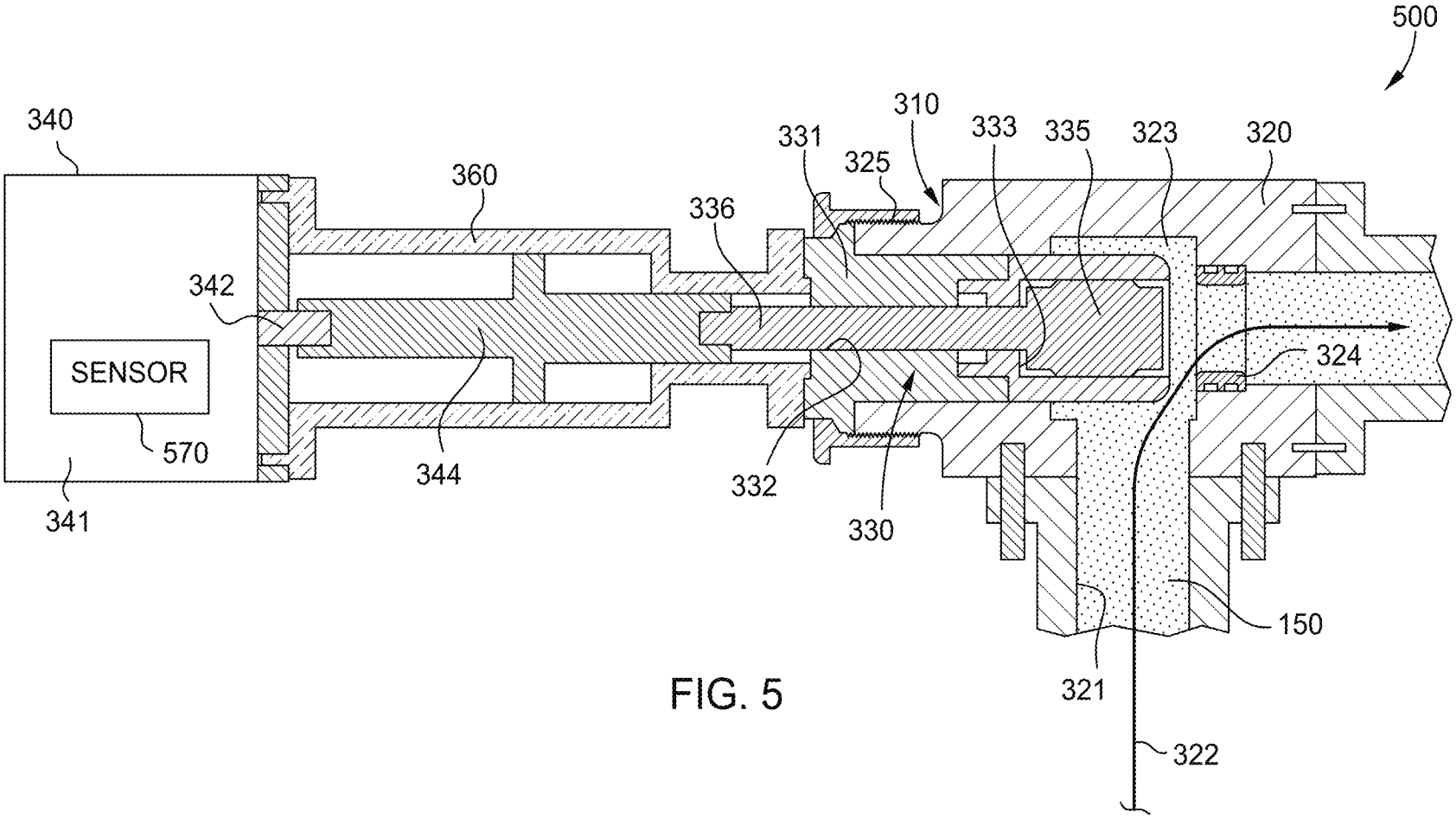
FIG. 5 is an exemplary choke system with a torque sensor, according to one or more embodiments of the disclosure.

The returning fluid 150 flows through the choke system 130. The choke system 130 includes a choke 131, an actuator 132, and a sensor 134. Choke 131 is wear resistant and is capable of operating at variable pressures, variable openings or apertures, and through multiple duty cycles. The choke 131 may be used to control the pressure in the wellbore 106 by only allowing a selected amount of fluid 150 to be discharged from the wellbore annulus 115 such that the discharge rate and/or pressure at a selected point in the wellbore 106 remains essentially at a selected value. The selected value may be constant or some other value. FIGS. 3-5, described herein, illustrate exemplary choke systems 300, 400, 500, which include a choke, actuator, and sensor that can be implemented in drilling system 100.

The choke 131 may be controlled by the actuator 132. The actuator 132 moves the choking member (see choking member 335 in FIG. 3) of the choke 131 to one or more positions to control the pressure of the fluid 150 flowing through the choke 131. The actuator 132 may be any suitable linear or non-linear actuator. The actuator 132 may be a hydraulic actuator, an electric actuator, or a pneumatic actuator. For example, the actuator may be an electric actuator with an electric motor configured to move the choking member. In some embodiments, the actuator 132 is a ball screw linear actuator. In some embodiments, the actuator 132 may include a gear box to facilitate providing the desired torque to operate the choke 131.

In conventional choking operations, a pressure sensor in communication with the fluid 150, such as being in-line with an inlet of the choke, is used to detect the pressure of the fluid 150 flowing through the choke, such as a pressure sensor upstream or downstream of the choking member. The pressure detected by the conventional pressure sensor is used to operate the choke. Pressure, however, can be affected based on the composition of the fluid 150 (e.g., mud properties) and the choking member geometry. Additionally, the pressure of the fluid 150 varies at a position of the choking member at different flow rates of the fluid 150 and/or different fluid compositions. In other words, there is not a direct correlation between the position of the choking member and the pressure of the fluid 150.

Additionally, the fluid 150 flowing through the choke may be compressible, such as being a multiphase fluid, which includes gas or one or more pockets of a gas. In conventional choking operations, the choking member is moved to increase the pressure as a compressible fluid is flowing through the choke. There is a lag between the position of the choking member and the increase in the pressure of the compressible fluid detected by the pressure sensor. The lag is due to the compressibility of the fluid, since some time is required for the compressible fluid to pressurize. The lag may result in the choking member being moved too quickly, which can result in the closing of the choke, which causes a pressure spike that requires urgently opening the choke. Conventional choke systems are therefore intentionally slowed down to accommodate compressible fluids to allow pressure to build up to mitigate the risk of unintentionally closing the choke. This limitation in actuation speed of choke systems decreases the ability of the choke to provide fine-tuned pressure control. In other words, conventional choke systems have a delay in the reaction time in operating the choke 131 to accommodate for the possibility of a compressible fluid flowing through the choke and pressure sensor.

Additionally, conventional pressure sensors are sensing the fluid directly. The fluid 150 may include cuttings and/or gases, which can cause the pressure reading data to be noisy as the cuttings and/or gases flow through the pressure sensor. The pressure sensor data must therefore be analyzed to determine the pressure. However, this analysis takes time to complete, which increases reaction time between reading a pressure and causing the actuator 132 to adjust the choke 131.

The choke system 130 of the present disclosure has the sensor 134 located external to the choke 131. The sensor 134 measures a parameter of the actuator 132, which is correlated with the pressure of the fluid 150. The sensor 134 avoids the noise issues caused by compressible fluids and/or cuttings being included in the fluid 150 because the sensor 134 is not in fluid communication with the fluid 150. Additionally, the pressure of the fluid 150, including when the fluid 150 is compressible, exerts a force on the choking member that fluctuates in real time. The sensor 134 is able to use the measured parameter to determine the force applied to the choking member or the force required to hold the choking member in a position to counteract the force applied by the fluid 150. The sensor 134 can therefore determine the pressure acting on the choking member in real time, such as within a few seconds of the pressure being exerted and the sensor 134 outputting a reading. Using the sensor 134 to determine pressure from an actuator parameter avoids the lag time associated with compressible fluids and the associated limitation in actuation speed. In other words, using the sensor 134 provides improved controllability of the choke 131 because the reaction time is decreased and the actuation speed need not be intentionally limited to accommodate potential compressible fluids flowing through the choke 131.

In some embodiments, the actuator parameter is the force exerted on the actuator 132 due to the pressure within the choke 131. In such embodiments, the sensor 134 is a suitable force sensor (e.g., force transducer) disposed between the choking member and the actuator 132 used to move the choking member. In some embodiments, the force sensor is disposed between a linkage between the actuator 132 and the choking member. The fluid 150 flowing by the choke member exerts a force on the choking member, which is measured by the sensor 134. The force exerted on the choking member by the fluid 150 is proportional to the pressure of the fluid 150. In other words, the pressure of the fluid 150 within the choke 131 may be measured by a force sensor located external to the flow path within the choke 131.

In some embodiments, the parameter may be torque generated by the actuator 132 or a current supplied to the actuator 132. As one example, the sensor 134 may be a torque sensor configured to measure a torque applied by the actuator 132 to maintain the choking member at a position to counteract the force applied by the fluid 150. The measured torque is correlated to the pressure of the fluid 150, such as being proportional to the pressure. As another example, the sensor 134 may be a current sensor configured to measure a current supplied to the actuator 132 to maintain the choking member at a position to counteract the force applied by the fluid 150. The measured current is proportional to the torque supplied by the actuator 132. The measured current is also correlated to the pressure of the fluid 150, such as being proportional to the pressure.

The controller 146 (e.g., control system) may use the parameter measured by the sensor 134 to operate the actuator 132 to adjust one or more properties (e.g., flow rate, pressure) of the fluid 150 flowing through the choke 131. In other words, the measured parameter may be used as a feedback loop that the controller 146 uses to operate the actuator 132 to achieve a desired pressure within the choke 131. In some embodiments, the actuator 132 may be operated until a desired pressure of the fluid 150 is sensed by the sensor 134. The sensor 134, by measuring force or an actuator parameter, avoids the noise problems and lag time associated with existing choke system. In other words, the choke system 130 of the present disclosure allows for faster pressure control because delays due to compressibility of the fluid 150 and the flow rate are avoided.

The fluid 150 exits the choke 131 and flows through a valve 5. The fluid 150 can then be processed by an optional degasser 1 and by a series of filters and shaker table 129, designed to remove contaminants, including drill cuttings, from the fluid 150. The fluid 150 is then returned to the reservoir 136. A flow loop including conduit 119A is provided in advance of a three-way valve 125 for conducting fluid 150 directly to the inlet of the backpressure pump 128. Alternatively, the backpressure pump 128 inlet may be provided with fluid from the reservoir 136 through conduit 119B, which is in fluid communication with the trip tank 2. The trip tank 2 is normally used on a drilling rig to monitor drilling fluid gains and losses during pipe tripping operations (withdrawing and inserting the full drill string or substantial subset thereof from the wellbore). The three-way valve 125 may be used to select the flow loop including conduit 119A, conduit 119B or to isolate the backpressure system. While the backpressure pump 128 is capable of utilizing returned fluid to create a backpressure by selection of the flow loop including conduit 119A, it will be appreciated that the returned fluid could have contaminants that would not have been removed by filter/shaker table 129. In such case, the wear on backpressure pump 128 may be increased. Therefore, the preferred fluid supply for the backpressure pump 128 is conduit 119A to provide reconditioned fluid to the inlet of the backpressure pump 128.

In operation, the three-way valve 125 would select either conduit 119A or conduit 119B, and the backpressure pump 128 may be engaged to ensure sufficient flow passes through the upstream side of the choke 131 to be able to maintain backpressure in the annulus 115, even when there is no drilling fluid flow coming from the annulus 115. In the present embodiment, the backpressure pump 128 is capable of providing up to approximately 2200 psi (15168.5 kPa) of pressure; though higher pressure capability pumps may be selected at the discretion of the system designer.

The system can include a flow meter 152 in conduit 140 to measure the amount of fluid being pumped into the annulus 115. It will be appreciated that by monitoring flow meters 126, 152 and thus the volume pumped by the backpressure pump 128, it is possible to determine the amount of fluid 150 being lost to the formation, or conversely, the amount of formation fluid entering to the wellbore 106. Further included in the system is a provision for monitoring wellbore pressure conditions and predicting wellbore 106 and annulus 115 pressure characteristics.

Figure 2:
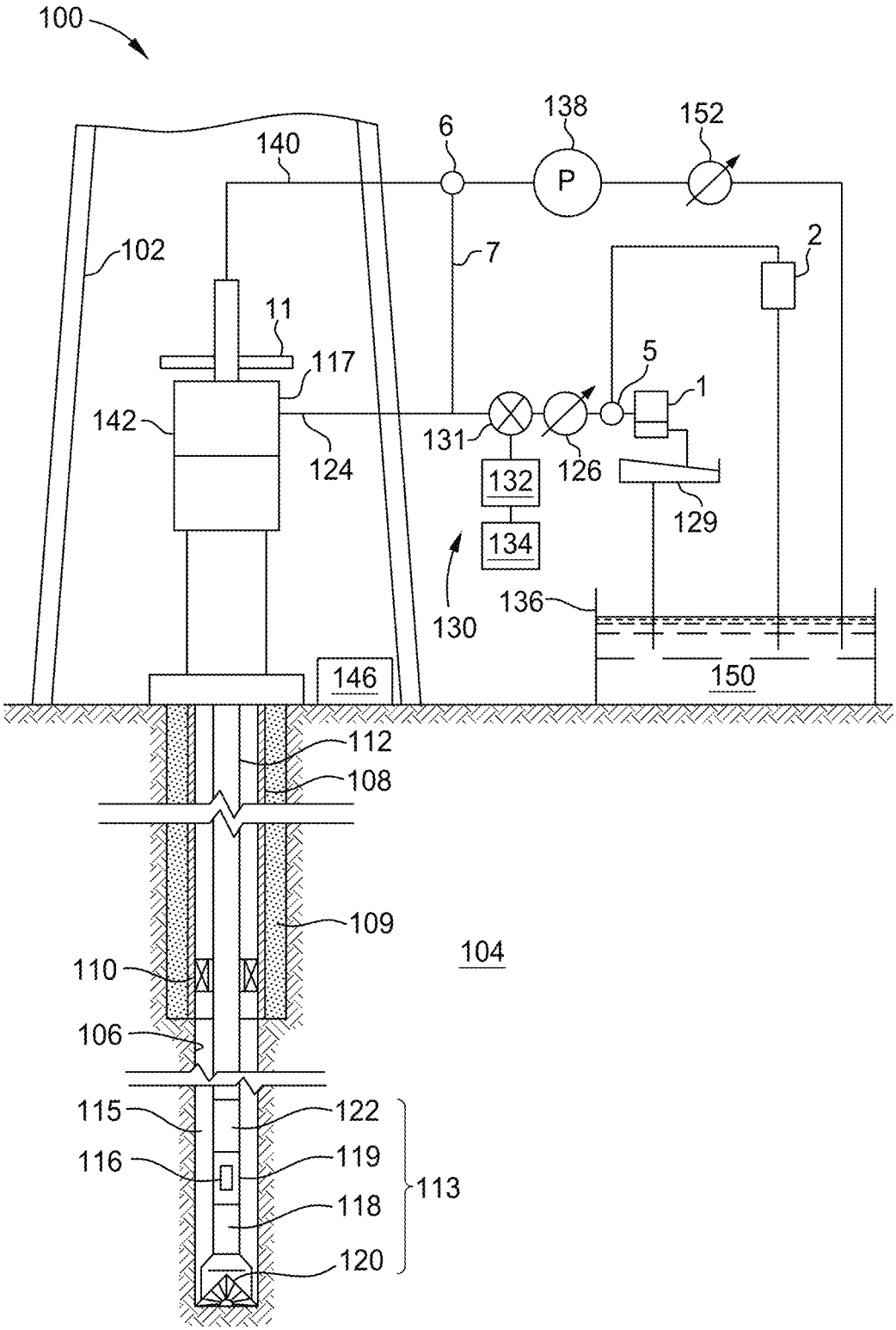
FIG. 2 is an exemplary drilling system using an alternative embodiment of dynamic annular pressure control, according to one or more embodiments of the disclosure.

FIG. 2 shows an alternative example of the drilling system. In this embodiment the backpressure pump is not required to maintain sufficient flow through the choke 131 when the flow through the wellbore needs to be shut off for any reason. In this embodiment, an additional three-way valve 6 is placed downstream of the drilling rig mud pumps 138 in conduit 140. This valve 6 allows fluid from the rig mud pumps 138 to be completely diverted from conduit 140 to conduit 7, thus diverting flow from the rig pumps 138 that would otherwise enter the interior passage of the drill string 112. By maintaining action of rig pumps 138 and diverting the pumps' 138 output to the annulus 115, sufficient flow through the choke 131 to control annulus backpressure is ensured.

FIG. 3 illustrates an exemplary choke system 300 that may be implemented in the drilling system 100. The choke system 300 includes a choke 310, an actuator 340, and a force sensor 370 (e.g., force transducer).

The choke 310 includes a choke housing 320 and a gate assembly 330. The choke housing 320 defines an interior flow passage 321 (e.g., flow path) that fluid 150 flows through. Arrow 322 shows the direction of the flow of the fluid 150 through the choke housing 320. The interior flow passage 321 is partially defined by a choke chamber 323 formed within the choke housing 320 and a seat element 324 disposed within the choke housing 320.

The gate assembly 330 is used to control the flow of the fluid 150 through the interior flow passage 321. The gate assembly 330 includes a gate body 331, a choking member 335, and a choke plunger 336. FIG. 3 shows the choking member 335 disposed at a fully open position, with the choking member 335 disposed within a choke receiving portion 333 formed in the gate body 331. The plunger 336 extends through a bore 332 in the gate body 331 and is connected to the choking member 335. The plunger 336 may be driven by the actuator 340 to move the choking member 335 to the fully closed position where the choking member 335 is seated against the seat element 324 to stop fluid flow through the interior flow passage 321. The actuator 340 may selectively move the plunger 336 to cause the choking member 335 to move to one or more positions between the fully open position and the fully closed position. The gate body 331 may be attached to the choke housing 320 by a threaded connection 325.

The actuator 340 includes a motor 341, an output member 342, and a linkage 344. As shown, the linkage 344 connects the output member 342 to the plunger 336. In some embodiments, the linkage 344 is omitted and the output member 342 is directly connected to the plunger 336. The motor 341 may be a hydraulic motor, an electric motor, a combustion motor, or a pneumatic motor. The output member 342 is configured to transfer the force generated by the motor 341 to move the choking member 335. For example, the actuator 340 may be a ball screw actuator, with the motor 341 being an electric motor and the output member 342 being a shaft that is translated by the motor 341 to one or more positions.

The motor 341 is shown connected to the choke 310 by a support member 360, such as a bonnet. As shown in FIG. 3, the motor 341 is mounted to one end of the support member 360 while the other end of the support member 360 is mounted to gate body 331. In some embodiments, and as shown in FIG. 3, the output member 342, linkage 344, and plunger 336 may be disposed within the support member 360. In some embodiments, a gantry may be connected to the support member 360 and to the choke 310.

The force sensor 370 is disposed between actuator 340 and the choking member 335. The force sensor 370 is positioned to measure the force exerted by the fluid 150 on the choking member 335. In some embodiments, and as shown in FIG. 3, the force sensor 370 may be disposed between and engaged with the output member 342 and the linkage 344. In some embodiments, the force sensor 370 may be located at an interface between the support member 360 and the gate body 331 as shown by dashed box 370A. In some embodiments, the force sensor 370 may be located at an interface between the plunger 336 and the linkage 344 as shown by dashed box 370B. In some embodiments, where the linkage 344 is omitted, the force sensor 370 may be located between and engaged with the output member 342 and the plunger 336.

The sensor 370 measures the force applied to the actuator 340 due to the pressure of the fluid 150 within the interior flow passage 321. In other words, the fluid 150 is exerting a force on an area of the choking member 335. This force is transferred to and sensed by the force sensor 370, such as the force being transferred from the choking member 335 to the force sensor 370 via the plunger 336 and linkage 344. In some embodiments, the linkage 344 may be a single component such as shown in FIG. 3 or composed of multiple components attached together.

The force measured by the sensor 370 is correlated to the pressure of the fluid 150. Without being bound by theory, the force measured by the sensor 370 is believed to be proportional (e.g., linearly correlated) to the pressure of the fluid 150.

The force measurements from the sensor 370 may be communicated to the controller 146. The controller 146 may use the force measurements to determine the pressure within the choke 310. Additionally, the controller 146 may control the actuator 340 to change the position of the choking member 335 to adjust the pressure of the fluid 150 based on the information obtained by the sensor 370.

The force is applied by the fluid 150 in real time and can be measured in real time, with minimal (e.g., a few seconds) delay between the sensor 370 registering the force applied by the fluid 150. The force can be used to adjust the position of the choking member 335 faster than conventional systems because there is no need to compensate for compressibility of the fluid 150, as the sensor 370 is registering the pressure experienced by the choking member 335. Additionally, measuring the current also avoids the noise issues caused by gas and cuttings flowing through a pressure sensor in communication with the interior flow passage 321.

As one example, the sensor 370 may register a force correlated with a first pressure. This first pressure is lower than a second pressure, the second pressure being the current desired pressure of the fluid 150. The controller 146 may cause the motor 341 to apply a force to the choking member 335 through the output member 342, linkage 344, and plunger 336 to raise the pressure of the fluid 150 to the second pressure. The choking member 335 will move towards the fully closed position until the force applied by the fluid balances the force applied by the actuator 340. In other words, the actuator 340 may be used to apply a force to the choking member 335 to increase the pressure of the fluid to a desired pressure. Similarly, the actuator 340 may be used to apply a force to the choking member 335 to decrease the pressure of the fluid to a desired pressure, such as allowing the choking member 335 to retract towards the fully open position until the force applied by the actuator 340 is balanced with the force applied by the fluid 150.

The controller 146 may be a programmable central processing unit ("CPU"), which is operable with a memory (e.g., non-transitory computer readable medium and/or non-volatile memory) and support circuits. For example, in one or more embodiments, the CPU is one of any form of general purpose computer processor used in an industrial setting, such as a programmable logic controller ("PLC"), for controlling various drilling system 100 components and sub-processors. The memory, coupled to the CPU, is non-transitory and is one or more of readily available memory such as random access memory ("RAM"), read only memory ("ROM"), floppy disk drive, hard disk, or any other form of digital storage, local or remote.

Herein, the memory is in the form of a computer-readable storage media containing instructions (e.g., non-volatile memory), that when executed by the CPU, facilitates the operation of the choke system 130 to control the pressure of the fluid 150. The instructions in the memory are in the form of a program product such as a program that implements the methods of the present disclosure (e.g., middleware application, equipment software application, etc.). The program code may conform to any one of a number of different programming languages. In one or more embodiments, the disclosure may be implemented as a program product stored on computer-readable storage media for use with a computer system. The program(s) of the program product define functions of the embodiments (including the methods and operations described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

FIG. 4 illustrates an exemplary choke system 400 that may be incorporated into drilling system 100. The choke system 400 has similar components as choke system 300 as indicated by the reference signs without reciting the description of these components of the choke system 400 for brevity. Choke system 400 differs from choke system 300 in that the actuator 340 has an electric motor 441, and the sensor 470 is a current sensor configured to measure a current supplied to the electric motor 441 by a power supply 490.

As explained above, the fluid 150 exerts a force on the choking member 335 that is experienced by the actuator 340, which is correlated with the pressure of the fluid 150. The current measured by the current sensor 470 is correlated to the force, such as torque, generated by the electric motor 441. Thus, the current measured by the current sensor 470 that is required for the electric motor 441 to generate sufficient force to hold the choking member 335 in a position can be similarly correlated to the pressure of the fluid 150.

The current measurements from the sensor 470 may be communicated to the controller 146. The controller 146 may use the current measurements to determine the pressure within the choke 310. Additionally, the controller 146 may control the actuator 340 to change the position of the choking member 335 to adjust the pressure of the fluid 150 based on the information obtained by the sensor 470. For example, the controller 146 may cause the actuator 340 to move the choking member 335 until the sensor 470 registers a current correlated with a desired pressure of the fluid 150.

The fluid 150 applies a force to the choking member 335 in real time and can be measured in real time, with minimal (e.g., a few seconds) delay between the sensor 470 registering the current required for the motor 441 to supply sufficient force to hold the choking member 335 in a position. The current measurements can be used to adjust the position of the choking member 335 faster than conventional systems because there is no need to compensate for compressibility of the fluid 150, as the current measured by the sensor 470 is correlated to the pressure experienced by the choking member 335. Additionally, measuring the current also avoids the noise issues caused by gas and cuttings flowing through a pressure sensor in communication with the interior flow passage 321.

As one example, the sensor 470 may register a current correlated with a first pressure. This first pressure is lower than a second pressure, the second pressure being the current desired pressure of the fluid 150. The controller 146 may cause an increase in the current supplied to the motor 441 by the power supply 490 to apply a force to the choking member 335 through the output member 342, linkage 344, and plunger 336 to raise the pressure of the fluid 150 to the second pressure. The choking member 335 will move towards the fully closed position until the force applied by the fluid balances the force applied by the actuator 340. The controller 146 may also determine that the desired pressure is reached based on the measured current.

FIG. 5 illustrates an exemplary choke system 500 that may be incorporated into drilling system 100. The choke system 500 has similar components as choke system 300 as indicated by the reference signs without reciting the description of these components of the choke system 500 for brevity. Choke system 500 differs from choke system 300 in that a torque sensor 570 is coupled to the motor 341 to measure the torque generated by the motor 341.

As explained above, the fluid 150 exerts a force on the choking member 335 that is experienced by the actuator 340 that is correlated with the pressure of the fluid 150. Thus, the torque measured by the torque sensor 570 that is required for the motor 341 to generate sufficient force to hold the choking member 335 in a position can be similarly correlated to the pressure of the fluid 150.

The torque measurements from the sensor 570 may be communicated to the controller 146. The controller 146 may use the torque measurements to determine the pressure within the choke 310. Additionally, the controller 146 may control the actuator 340 to change the position of the choking member 335 to adjust the pressure of the fluid 150 based on the information obtained by the sensor 570. For example, the controller 146 may cause the actuator 340 to move the choking member 335 until the sensor 570 registers a torque correlated with a desired pressure of the fluid 150.

The fluid 150 applies a force to the choking member 335 in real time and can be measured in real time, with minimal (e.g., a few seconds) delay between the sensor 570 registering the torque required for the motor 341 to supply sufficient force to hold the choking member 335 in a position. The torque measurements can be used to adjust the position of the choking member 335 faster than conventional systems because there is no need to compensate for compressibility of the fluid 150, as the torque measured by the sensor 570 is correlated with the pressure experienced by the choking member 335. Additionally, measuring the torque also avoids the noise issues caused by gas and cuttings flowing through a pressure sensor in communication with the interior flow passage 321.

As one example, the sensor 570 may register a torque correlated with a first pressure. This first pressure is lower than a second pressure, the second pressure being the current desired pressure of the fluid 150. The controller 146 may operate the motor 341 to increase the torque generated by the motor 341 to apply a force to the choking member 335 through the output member 342, linkage 344, and plunger 336 to raise the pressure of the fluid 150 to the second pressure. The choking member 335 will move towards the fully closed position until the force applied by the fluid balances the force applied by the actuator 340. The controller 146 may also determine that the desired pressure is reached based on the measured torque.

In some embodiments, the choke system may be controlled to achieve a desired pressure of the fluid by monitoring the pressure with the aforementioned sensors 370, 470, 570 as the choking member 335 is moved by the actuator 340. As one example, the controller 146 determines the pressure of the fluid 150 within the interior flow passage 321 based on the information obtained from one of the aforementioned sensors 370, 470, 570. The controller 146 compares the pressure to a desired pressure of the fluid 150. If the pressure is not equivalent to the desired pressure, then the controller 146 causes the actuator 340 to adjust the position of the choking member 335 to change the pressure. The controller 146 may monitor the information from the sensor as the choking member 335 is moved to evaluate when the desired pressure is reached. The controller 146 may then cause the actuator 340 to stop moving the choking member 335 once the desired pressure is achieved.

The information registered by the sensors 370, 470, 570, the force applied by the actuator 340, and/or the position of the choking member 335 may be logged by the controller 146. The controller 146 may use this logged data for preventative maintenance purposes, such as predicting when the choke system needs to be serviced.

In some embodiments, the controller 146 may detect a change in the position of the choking member 335 while the force applied by the actuator 340 remains constant. In other words, the position of the choking member 335 may change while the sensors 370, 470, 570 do not show a change or substantial change in the pressure of the fluid. This position change is indicative of a change of the composition of the fluid 150, such as indicating that the mud is diluted.

Example Aspects

Implementation examples are described in the following numbered aspects:

Aspect 1: A choke system for oilfield operations, comprising: an actuator; a choke including: a housing defining an interior flow path; a choke plunger coupled to and movable by the actuator; and a choking member coupled to and movable by the choke plunger within the interior flow path to adjust a pressure of a fluid in the interior flow path; a force sensor disposed between the actuator and the choking member, the force sensor configured to measure a force exerted on the choking member by the fluid; and a control system configured to control the pressure of the fluid by: determining the pressure of the fluid based on the force measured by the force sensor, and wherein the force is proportional to the pressure of the fluid; and actuating the actuator to cause the choking member to move within the interior flow path until the pressure of the fluid reaches a desired pressure.

Aspect 2: The choke system of Aspect 1, wherein the actuator is a linear actuator.

Aspect 3: The choke system of Aspect 1, wherein the actuator is a motor.

Aspect 4: The choke system of any combination of Aspects 1-2, wherein the actuator further comprises a linkage connecting an output member of the actuator to the choke plunger, wherein the force sensor is engaged with the output member and the linkage.

Aspect 5: The choke system of any combination of Aspects 1-4, wherein the choking member is configured to move laterally within the interior flow path.

Aspect 6: The choke system any combination of Aspects 1-5, wherein the control system is configured to log the pressure of the fluid and actuation of the actuator.

Aspect 7: A choke system for oilfield operations, comprising: an actuator; a choke including: a housing defining an interior flow path; a choke plunger coupled to and movable by the actuator; and a choking member coupled to and movable by the choke plunger within the interior flow path to adjust a pressure of a fluid in the interior flow path; a sensor external to the choke, the sensor configured to measure an actuator parameter; and a control system configured to control the pressure of the fluid by: determining the pressure of the fluid based on the actuator parameter measured by the sensor, and wherein the actuator parameter is proportional to the pressure of the fluid; and actuating the actuator to cause the choking member to move within the interior flow path until the pressure of the fluid reaches a desired pressure.

Aspect 8: The choke system of Aspect 7, wherein the actuator is a linear actuator.

Aspect 9: The choke system of Aspect 7, wherein the actuator is a motor.

Aspect 10: The choke system of any combination of Aspects 7-9, wherein the actuator parameter is a torque applied by the motor.

Aspect 11: The choke system of any combination of Aspect 7-9, wherein the actuator parameter is a force applied on the actuator by the fluid.

Aspect 12: The choke system of Aspect 11, wherein the actuator further comprises a linkage connecting an output member of the actuator to the choke plunger, wherein the sensor is a force sensor engaged with the output member and the linkage.

Aspect 13: The choke system of any combination of Aspects 7-9, wherein the actuator parameter is a current supplied to the actuator.

Aspect 14: The choke system of any combination of Aspects 7-13, wherein the control system is further comprised to store the actuator parameter.

Aspect 15: The choke system of any combination of Aspects 7-14, wherein the control system is configured to log the pressure of the fluid and actuation of the actuator.

Aspect 16: A method for managing a choked fluid pressure, comprising: measuring a parameter of an actuator coupled to a choke with a sensor while a fluid is flowing through an interior flow path of the choke; and applying a force with the actuator to a choking member of the choke disposed within an interior flow path to change a pressure of the fluid based on the measured parameter.

Aspect 17: The method of Aspect 16, wherein the actuator is a linear actuator.

Aspect 18: The method of Aspect 16, wherein the actuator is a motor and the parameter is a torque applied by the motor to apply the force on the choking member.

Aspect 19: The method of any combination of Aspects 16-17, wherein the parameter is a current supplied to the actuator.

Aspect 20: The method of any combination of Aspects 16-17, wherein the sensor is a force sensor disposed between the actuator and the choking member and the parameter is a force exerted on the choking member by the fluid.

It is contemplated that any one or more elements or features of any one disclosed embodiment or example may be beneficially incorporated in any one or more other non-mutually exclusive embodiments or examples. While the foregoing is directed to embodiments of the present disclosure, other and further embodiments of the disclosure may be devised without departing from the basic scope thereof, and the scope thereof is determined by the claims that follow.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for". All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A choke system for oilfield operations, comprising:
an actuator;
a choke including:
a housing defining an interior flow path;
a choke plunger coupled to and movable by the actuator; and
a choking member coupled to and movable by the choke plunger within the interior flow path to adjust a pressure of a fluid in the interior flow path;
a linear force sensor disposed between the actuator and the choking member, the linear force sensor configured to measure a force exerted on the choking member by the fluid; and
a control system configured to control the pressure of the fluid by:
determining the pressure of the fluid based on the force measured by the linear force sensor, wherein the force is proportional to the pressure of the fluid; and
actuating the actuator to cause the choking member to move within the interior flow path until the pressure of the fluid reaches a desired pressure.

2. The choke system of claim 1, wherein the actuator is a linear actuator.

3. The choke system of claim 1, wherein the actuator is a motor.

4. The choke system of claim 1, wherein the actuator further comprises a linkage connecting an output member of the actuator to the choke plunger, wherein the linear force sensor is engaged with the output member and the linkage.

5. The choke system of claim 1, wherein the choking member is configured to move laterally within the interior flow path.

6. The choke system of claim 1, wherein the control system is configured to log the pressure of the fluid and actuation of the actuator.

7. A choke system for oilfield operations, comprising:
an actuator;
a choke including:
a housing defining an interior flow path;
a choke plunger coupled to and movable by the actuator; and
a choking member coupled to and movable by the choke plunger within the interior flow path to adjust a pressure of a fluid in the interior flow path;
a sensor external to the choke, the sensor configured to measure an actuator parameter, the actuator parameter comprising a current supplied to the actuator, and the sensor comprising a current sensor configured to measure the current supplied to the actuator needed to drive the choke plunger; and
a control system configured to control the pressure of the fluid by:
determining the pressure of the fluid based on the actuator parameter measured by the sensor, wherein the actuator parameter is proportional to the pressure of the fluid; and
actuating the actuator to cause the choking member to move within the interior flow path until the pressure of the fluid reaches a desired pressure.

8. The choke system of claim 7, wherein the actuator is a linear actuator.

9. The choke system of claim 7, wherein the actuator is a motor.

10. The choke system of claim 7, wherein the control system is further configured to store the actuator parameter.

11. The choke system of claim 7, wherein the control system is configured to log the pressure of the fluid and actuation of the actuator.

12. A method for managing a choked fluid pressure, comprising:
measuring a parameter of an actuator coupled to a choke with a sensor while a fluid is flowing through an interior flow path of the choke, the parameter comprising a current supplied to the actuator; and
applying an actuation force with the actuator to a choking member of the choke disposed within the interior flow path to change a pressure of the fluid based on the parameter.

13. The method of claim 12, wherein the actuator is a linear actuator.

* * * * *